United States Patent [19]

Thomas

[11] Patent Number: 4,524,991

[45] Date of Patent: Jun. 25, 1985

[54] SNAP ON DEVICE FOR HARDCOVER RING BINDER

[76] Inventor: Ralph D. Thomas, 7104 Granada La., Fox Lake, Ill. 60020

[21] Appl. No.: 508,079

[22] Filed: Jun. 27, 1983

[51] Int. Cl.[3] ..... B42D 1/00; B42D 17/00; B42D 3/06

[52] U.S. Cl. ..... 281/20; 281/40; 281/45

[58] Field of Search ..... 281/20, 24, 29, 45; 412/3; 49/462; 241/262; 150/46; 108/50

[56] References Cited

U.S. PATENT DOCUMENTS

| | | | |
|---|---|---|---|
| 763,554 | 6/1904 | Greene | 281/20 |
| 806,459 | 12/1905 | Brown | 49/462 |
| 1,118,637 | 11/1914 | Dawson | 281/45 |

FOREIGN PATENT DOCUMENTS

| | | | |
|---|---|---|---|
| 49747 | 6/1889 | Fed. Rep. of Germany | 281/20 |
| 154809 | 5/1938 | Fed. Rep. of Germany | 281/20 |
| 692472 | 5/1940 | Fed. Rep. of Germany | 281/20 |
| 270395 | 5/1927 | United Kingdom | 281/20 |

*Primary Examiner*—Paul A. Bell
*Assistant Examiner*—Paul M. Heyrana, Sr.
*Attorney, Agent, or Firm*—Mathew R. P. Perrone, Jr.

[57] ABSTRACT

The snap on device having a U-shaped support with a spacer bar secured down the channel of the U-shaped support and a tension strip secured to the spacer bar and substantially filling the channel creates a device capable of being snapped onto a hard cover ring binder and equalizing the thickness of the binder from its spine to its opening side.

20 Claims, 6 Drawing Figures

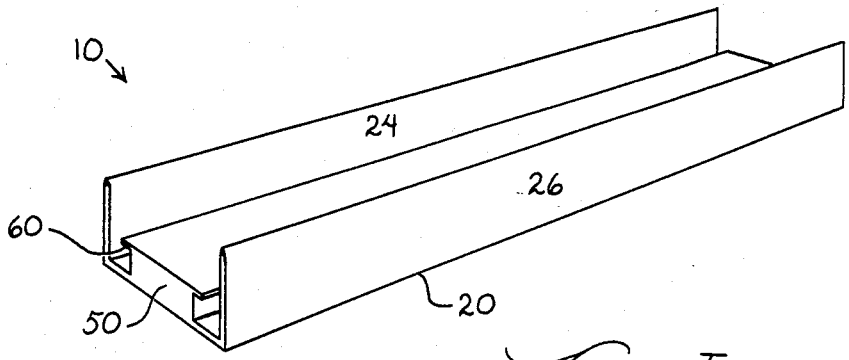
Fig. I
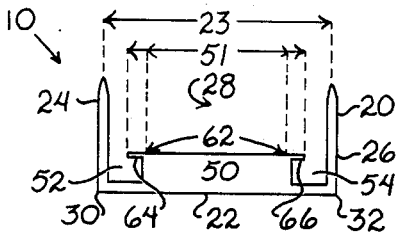
Fig. II
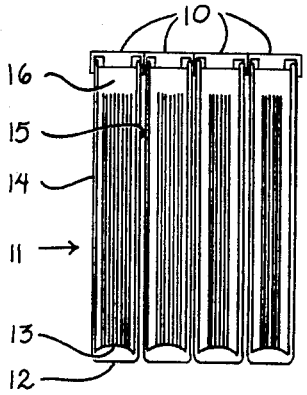
Fig. III
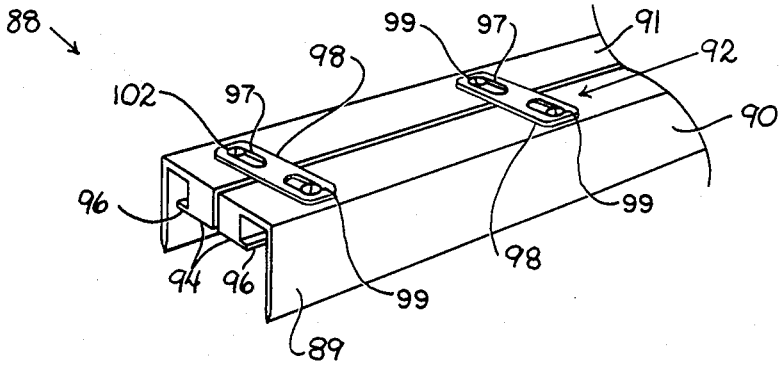
Fig. IV

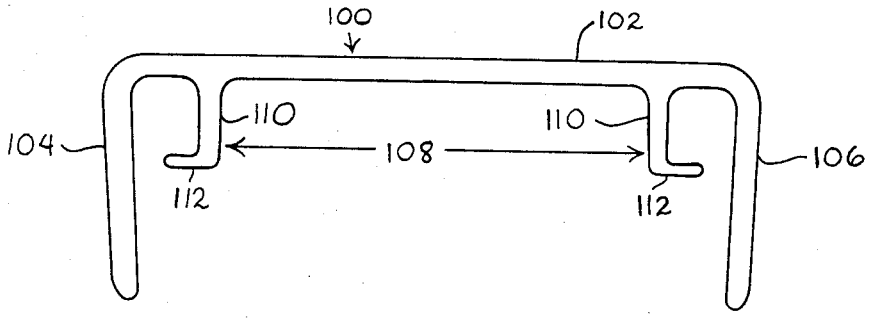
Fig. V
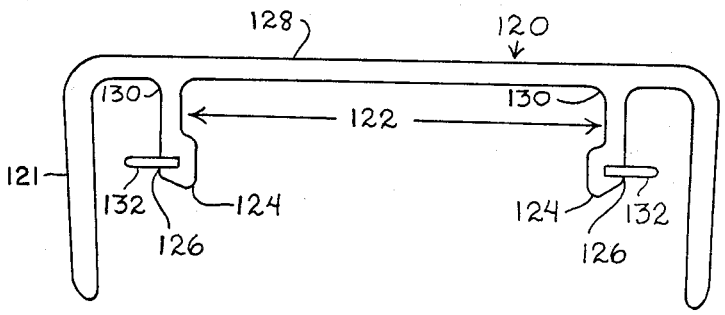
Fig. VI

SNAP ON DEVICE FOR HARDCOVER RING BINDER

BACKGROUND OF THE INVENTION

This invention relates to a device useful in assisting to make a ring binder more efficient to use, and more particularly a device capable of making the opening side of the binder substantially equal to the spine side of the ring binder.

Ring binders are in great use in various fields of endeavor. Students use them at all levels of education, businesses use them to store information, and provide for readily changeable information. Other educational sources use them to provide books or other materials which can be easily updated by merely changing the loose leaf sheets within the ring binder. Such ring binders have long been known in the art and have a wide variety of uses.

In spite of the long period of use of ring binders, some major problems still remain with the use of a ring binder. These problems greatly reduce the advantages of a ring binder. It is, of course, desirable to maintain the advantages of a ring binder while solving some of these problems.

One problem occurs because it is extremely difficult to properly stack or store a ring binder with other ring binders. The wedge shape of a ring binder interferes with the stacking or storing of a ring binder. A standard ring binder has a structure, which leads from a spine side to an opening side. The opening side is generally of less thickness than the spine side, which leads to a wedge shape. However, this problem is inherent in the nature of a ring binder.

Another problem occurs because the binder is designed to contain material. If the material is in the binder, the open side is not necessarily of equal thickness with the spine side. Furthermore, since the open side leaves the binder cover free to move relative to the other side of the binder cover, the binder may be opened at undesirable times. If a device could be found to equalize the width of the binder at the open side and at the spine side, great improvements in the use of a ring binder can result.

Furthermore, a frequent user of notebooks to carry material can to great dismay, find that upon stuffing a three-ring binder into a briefcase or similar carrying device, another item within the briefcase has entered the binder and caused damage to the material therein. If the material is so damaged, it becomes unsightly and therefore unsuitable for the person to use in—for example, a sales presentation.

Thus, it becomes clear that it is highly desirable to have a device which improves the utility of the already versatile ring binder.

SUMMARY OF THE INVENTION

Therefore, it is an object of this invention to provide a device capable of rendering the ring binder stackable or storable.

It is a further object of this invention to provide a device capable of equalizing the open side width to the spine width.

Yet it is a further object of this invention to hold covers of a ring binder firmly closed.

Also, an object of this invention is to provide a device to protect materials within the ring binder itself.

Another object of this invention is to provide a device which is adjustable so as to fit a wide variety of ring binders.

These and other objects of this invention are met by providing a binder snap on device having a U-shaped support with a spacer secured therein and a binder contact strip secured to the spacer.

BRIEF DESCRIPTION OF THE DRAWINGS

FIG. I is a perspective view of binder snap on device 10 of this invention.

FIG. II is an end view of FIG. I.

FIG. III is an view of a plurality of snap on devices 10 of this invention used with a stack of binders 11.

FIG. IV is a partial perspective view of adjustable snap on device 88 of this invention.

FIG. V is a end view of unitary device 110 as another embodiment of snap on device 10 of this invention.

FIG. VI is a end view of slotted device 120 as another embodiment of binder snap on device 10 of this invention.

Throughout the Figures of the Drawings, where the same part appears in more than one Figure, the same number is given thereto.

DESCRIPTION OF THE PREFERRED EMBODIMENTS

A binder snap on device is formed with a U-shaped support having a spacer bar secured therein with a tension strip secured to the spacer bar.

Referring now to FIG. I and FIG. III, which depicts a binder snap on device 10 of the invention secured in a removable fashion to binder 11, the advantages of a binder snap on device become clear.

As is known in the art a ring binder 11, includes a binder spine 12, having a paperlock 13 secured to the binder spine. Protruding from the binder spine at one side of paperlock 13 is first binder cover 14. Oppositely disposed from first binder cover 14 is second binder 15. Second binder cover 15 and first binder cover 14 combine to form a binder opening 16 encasing paperlock 13 therein. It is binder opening 16 which can cause problems that implements or foreign material to enter the binder and damage the sheets within the binder.

Binder snap on device 10 of this invention prevents this problem. Binder snap on device alters the tapered shape of loose leaf hard cover ring binder 11 by substantially equalizing the thickness of binder 11 from its spine 12 to its binder opening 16. In this fashion, a number of binders 11 can be stacked at a neat, stable and orderly fashion. This device 10 also assists in preventing premature cracking or splitting of first binder cover 14 and second binder cover 15 by preventing undue stress thereon. Also device 10 by being removably secured to binder 11 prevents the entry of the other material in a briefcase into the binder opening 16 and damage to the material therein.

Referring now to FIG. I and FIG. II, binder snap on device 10 accomplishes these desired results by providing a U-shaped support 20, having a support base 22, with a first support edge 24, extending from support base 22, and a second support edge 26 extending from support base 22 and parallel to first support edge 24. In a preferred embodiment, first support edge 24 and second support edge 26 are perpendicular to support base 22, and form a channel 28 therebetween. In most cases, clearly first support edge 24 and second support edge 26 respectively, are generally perpendicular to support base 22 at first base edge 30 and second edge 32 respectively. In this fashion, U-shaped support 20 is formed.

Secured within U-shaped support 20 is spacer bar 50. The spacer width 51 of spacer bar 50 is less than the support width 23 of support base 22, but spacer bar 50 is substantially the same length as support base 22. In this fashion, first binder cover channel 52 is formed and can receive first binder cover 14. In a similar fashion, second binder cover channel 54 can receive second binder cover 15. This arrangement is also reversible due to the similar size first binder cover 14 and second binder cover 15.

Spacer bar 50 serves to recess the tension strip 60 within U-shaped support 20 so that the first binder cover 14 and second binder cover 15 may contact tension strip 60 to pressure exerted against the inner sides thereof so that binder snap on device 10 may be held thereon, but not so deep as to interfere with the pages or page tabs within the binder 11 itself. Thus, spacer bar 50 has sufficient rigidity to carry out its function.

Tension strip 60 is secured to spacer bar 50 on the side of spacer bar 50 opposite support base 22. Tension strip 60 is made of a flexible material and almost completely fills binder channel 28. It is tension strip 60 that permits first binder cover 14 to be held within first binder cover channel 52 and second binder cover 15 to be held within second binder cover channel 54.

Tension strip 60 is secured to space bar 50 at central portions 62 thereof. First channel portion 64 of tension strip 60 is one side of tension portion 62 while second channel portion 66 is on the other side of central portion 62.

Thus, it may be seen, that U-shaped support combined with spacer bar 50 and tension strip 60 to form a device suitable to carrying out the purpose of this invention. This cooperation is achieved by the spacer bar forming first binder cover channel 52 and second binder channel cover 54 so that first channel strip 64 and second channel strip 66 can cooperate with first binder cover 14 and second binder cover 15 to hold U-shaped support on ring binder 11. In this fashion, the results of the invention are achieved.

It is also clearly possible by considering FIG. IV to see that the binder snap on device 10 of this invention can be made into adjustable snap device 88 by replacing U-shaped support 20 with adjustable U-shaped support 89. Adjustable U-shaped support 89 is joined by slotted screw mechanism 92 at either end thereof. Split spacer bar 94 is secured half to one part of adjustable U-shaped support number and half to the other part of U-shaped support number as is tension strip 96. Slotted screw mechanism 92 provides for adjusting the width of binder snap on device to accommodate the appropriate binder 11. In all other fashions, but for the split, adjustable snap device 88 is similar to binder snap on device 10.

Slotted screw mechanism 92 includes two slotted bars 98, each of slotted bars 98 having two screw receiving slots 97 therein. Screws 99 pass through slots 97 into threaded relation with first section 90 and second section 91 of adjustable U-shaped support 89. Screws 99 hold slotted bar 98 in position when tightened. Slots 97 permit width adjustment.

Of course, binder snap on device 10 can be made in various sizes to fit various standard size of ring binders 11. It is contemplated, that four different sizes of binder snap on device 10 will fit the market. However, adjustable U-shaped number 88 can serve the same purpose.

For the spacer bar 50 and U-shaped support 20, a relatively rigid material is used. These rigid members when combined with the flexibility of tension strip 60 permit binder 11 to be held properly by binder snap on device 10. In this fashion, binder snap on device 10 permits stacking of binder 11 with a plurality thereof; also prevents damage to contents of binder 11 when binder 11 is inserted into a briefcase or similar carrying article and otherwise renders the binder 11 more useful.

FIG. V relates to a modification of binder snap on device 10. In FIG. V is shown unitary device 100. Unitary device 100 includes a U-shaped base 102 so similar to U-shaped support 20 of binder snap-on device 10, that U-shaped base 102 includes a first base support lip 104 similar to first support edge 24, and a second base support lip 106 similar to second support edge 26.

U-shaped base 102 includes a pair of unitary footers 108, one of said unitary footers 108 being adjacent and parallel to first base lip 104, and the other of the unitary footers 108 being parallel to second base lip 106. Unitary footers 108 are generally L-shaped and each has a leg 110 parallel to first base lip 104 or second base lip 106. Footers 108 further include a flange 112. Each of the flange 112 are substantially perpendicular to first base lip 104 or second base lip 106 and are spaced sufficiently from the base to allow footed device 110 to fit on binder 11.

FIG. VI depicts binder snap on device 10 modified to be slotted device 120. Slotted device 120 includes slotted support 121 with slotted footers 122 therein. Slotted support 121 is similar to U-shaped support 20. Slotted footers 122 have a knobbed end 124 which is enlarged and has a knobbed slot 126 therein. The knobbed support 128 supports slotted footers 122 in a fashion similar to the U-shaped base 102. Slotted footers 122 are secured to knobbed support 128 at knob base 130. Flexible bars 132 are secured in each of knobbed slot 126 to contact binder 11.

Common to snap on device 10, adjustable snap device 88, unitary device 100 and slotted device 120 are first binder cover channel 52 and second binder cover channel 54. Clearly first binder cover channel 52 and second binder cover channel 54 are wider than either first binder cover 14 or second binder cover 15 is thick. This feature permits first binder cover 14 to fit into either first first binder cover channel 52 or second binder cover channel 54. Clearly first binder cover channel 52 and second binder cover channel 54 can be interchangable with respect to which binder either may contact. If the thickness of first binder cover 14 varies from that of second binder cover 15, first binder cover channel 52 and second binder cover channel 54 may be adjusted to compensate therefor.

More preferrably, first binder cover channel 52 and second binder cover channel 54 are about 1.1 to 3.5 times wider than either first binder cover 14 or second binder cover 15 is thick (depending on channel contacts which cover). More preferrably, first binder cover channel 52 and second binder cover channel 54 are about 1.5 to 2.5 times wider than either first binder cover 14 or second binder cover 15 is thick. These factors relate to the thickness of the cover, with which contact is made.

With the commonality of first binder channel 52 and second binder channel 54, it becomes clear that spacer bar 50, split spacer bar 94, unitary footer 108 and slotted footer 122 all serve an equivalent function of recessing a holding apparatus within a channel for contacting first binder cover 14 and second binder cover 15. Similarly, flexible bars 132, flange 112, and first channel portion 64 and second channel portion 66 serve an equivalent of reducing the width of first binder cover channel 52 and second binder cover channel 54 less than the thickness of first binder cover 14 or second binder 15; so that they may flex and hold the respective devices in place on binder 11 to render binder 11 flat and storable. FIG. III illustrates this function.

More preferrably, first binder cover channel 52 and second binder cover channel 54 are reduced to 0.3 to 0.9 times the thickness of either first binder cover 14 or second binder cover 15 (depending on channel contacts which cover). Most preferrably, first binder cover channel 52 and second binder cover channel 54 are about 0.4 to 0.7 times the thickness of either first binder cover 14 or second binder cover 15. These factors relate to the thickness of the cover, with which contact is made.

Appropriate material for making the devices of this invention is that which can be flexible when thin and rigid when thick. The material may be plastic or synthetic resin. Metal may used for the rigid parts. A flexible and resilient metal may be to contact and holder binder 11. Synthetic resin or plastic material is preferred. Mixtures of materials of the same or different may be used.

The devices of this invention may be manufactured or assembled in any suitable way. The component parts may be assembled mechanically, or joined by chemical or thermobonding. The piece itself or the component parts thereof may be molded, formed, shaped, machined or otherwise formed into the proper shape and dimensions. Unitary molding is also possible. Assembling of parts is possible. Any method, which may achieve the desired article is usable.

Because of this disclosure and solely because of this disclosure, various modifications to binder snap on device 10 will become clear to those having ordinary skill to the art. Such modifications are clearly covered hereby.

What is claimed and sought to be secured by Letters Patent of the United States is:

1. A device to be removably attached to an openable side of a ring binder, said ring binder having two covers and a spine with a paperlock secured to said spine, said device having sufficient length to protect material contained within said ring binder and said device having sufficient width to render said covers substantially flat with said ring binder in a closed configuration to thereby simplify storing of said ring binder wherein:

a. said device includes a U-shaped support having a channel as an interior portion thereof;

b. a spacer means is secured within said channel to form a first binder cover channel and a second binder cover channel within said channel; and c. a flexible binder contact means is secured to said spacer means within said channel and is capable of flexibly contacting each cover of said binder and cooperating with said U-shaped support to render said ring binder flat in the closed configuration and protect said material in said binder.

2. The device of claim 1 wherein:

a. said U-shaped support includes a base, a first support edge extending from a first side of said base, and a cccond support edge extending from a second of said base and substantially parallel to said first support edge to thereby form a U-channel in said U-shaped support;

b. said spacer means is secured within said U-channel; and cooperates with said first support edge to form said first binder cover channel between said first support edge, and said spacer means cooperates with said second support edge to form said second binder cover channel between said second support and said spacer means;

c. said first binder cover channel and said second binder cover channel are wider than a binder cover of said binder is thick.

3. The device of claim 2 wherein said first binder cover channel and said second binder cover channel are each 1.1 to 3.5 times wider than said binder cover is thick.

4. The device of claim 3 wherein said first binder cover channel and said second binder cover channel are each 1.5 to 2.5 times wider than said binder cover is thick.

5. The device of claim 3 wherein said flexible binder cover contact means reduces said the width of first binder cover channel and said second binder cover channel to less than the thickness of said binder cover.

6. The device of claim 5 wherein said flexible binder cover contact means reduces said the width of first binder cover channel and said second binder cover channel to 0.3 to 0.9 times the thickness of said binder cover.

7. The device of claim 6 wherein said flexible binder cover contact means reduces said the width of first binder cover channel and said second binder cover channel to 0.4 to 0.7.

8. In a ring binder, said ring binder including a binder spine, a paperlock secured to said binder spine, a first binder cover movably secured to said binder spine at one side of said paperlock, a second binder cover oppositely disposed from first binder cover and movably secured to said binder spine at an opposing side of said paperlock, said second binder cover combining with said first binder cover combine to form a binder opening, said binder opening being oppositely disposed from said binder spine and encasing paperlock within said ring binder, the improvement comprising: a device having sufficient length to protect material contained within said ring binder and having sufficient width to render said ring binder substantially flat to thereby simplify storing of said ring binder in a closed configuration wherein:

a. said device includes a U-shaped support having a channel as an interior portion thereof;

b. a spacer means is secured within said channel to form a first binder cover channel and a second binder cover channel wthin said channel; and c. a flexible binder contact means is secured to said spacer means, said contact means contacting said first binder cover and said second binder cover at said opening to thereby render said binder flat and protect contents of said binder.

9. The device of claim 8 wherein said U-shaped support includes a support base, a first support edge extending from said support base and a second support edge extending from said support base and parallel to said first support edge.

10. The device of claim 9 wherein said U-shaped support wherein said first support edge and said second support edge are substantially perpendicular to said support base to thereby form said channel therebetween, wherein the width of said first support edge is substantially equal to the width of said second support edge.

11. The device of claim 10 wherein said spacer means is a spacer bar, said spacer bar having a spacer width less than a support width of said support base and a spacer length of said spacer bar substantially the same as a support length of said support base.

12. The device of claim 11 wherein said spacer bar cooperates with said first support edge to form a first binder cover channel to receive said first binder cover, said first binder cover channel is between said spacer bar and said first support edge and wherein said spacer bar cooperates with said second support edge to form a second binder cover channel to receive said second binder cover, said second binder cover channel is between said spacer bar and said second support edge.

13. The device of claim 12 wherein said spacer bar is of uniform thickness and has a thickness less than the width of said first support edge.

14. The device of claim 13 wherein said flexible binder contact means is a tension strip secured to said spacer bar, said tension strip having a width greater than the width of said spacer bar and less than said support width, a first cover slot being the distance between an adjacent edge of said tension strip and said first support edge and a second cover slot being the distance between an adjacent edge of said tension strip and said second support edge, said first cover slot having a width less than the thickness of said first binder cover and said second cover slot having a width less than the thickness of said second binder cover.

15. The device of claim 14 wherein said first binder cover channel is substantially equal to said second binder cover channel in a channel width dimension, and said channel width dimension is greater than the thickness of said first binder cover and said second binder cover individually.

16. In a ring binder, said ring binder including a binder spine, a paperlock secured to said binder spine, a first binder cover movably secured to said binder spine at one side of said paperlock, a second binder cover oppositely disposed from first binder cover and movably secured to said binder spine at an opposing side of said paperlock, said second binder cover combining with said first binder cover combine to form a binder opening, said binder opening being oppositely disposed from said binder spine and encasing paperlock within said ring binder, the improvement comprising: an adjustable device having sufficient length to protect material contained within said ring binder and having sufficient width to render said ring binder substantially flat to thereby simplify storing of said ring binder in a closed configuration wherein:

a. said device includes a split U-shaped support having a channel as an interior portion thereof;
b. a split spacer means is secured within said channel to form a first binder cover channel and a second binder cover channel within said channel; and
c. a split flexible binder contact means is secured to said spacer means, said contact means contacting said first binder cover and said binder cover at said opening to thereby render said binder flat and protect contents of said binder.

17. The adjustable device of claim 16 wherein:

a. Said split U-shaped support includes a first support half and a second support half, said first support half being a mirror image of said second support half;
b. Said split spacer means is secured within said channel and is a split spacer bar, said split spacer bar includes a first spacer bar half secured to said first support half and a second spacer bar half secured to said second support half.

18. The adjustable device of claim 17 wherein said adjustable device includes an adjusting means, and said adjusting means includes:

a. a slotted screw mechanism;
b. said slotted screw mechanism including a pair of slotted bars;
c. said slotted bars having two screw receiving slots; and
d. screws passing through said screw receiving slots into threaded relation with said first support half and said second half; the positioning of said screws within said slots to permit width adjustment.

19. In a ring binder, said ring binder including a binder spine, a paperlock secured to said binder spine, a first binder cover movably secured to said binder spine at one side of said paperlock, a second binder cover oppositely disposed from first binder cover and movably secured to said binder spine at an opposing side of said paperlock, said second binder cover combining with said first binder cover combine to form a binder opening, said binder opening being oppositely disposed from said binder spine and encasing paperlock within said ring binder, the improvement comprising: a footed device having sufficient length to protect material contained within said ring binder and sufficient width to render said ring binder substantially flat in closed configurations to thereby simplify storing of said ring binder wherein:

a. said footed device includes a U-shaped base, said U-shaped base having a channel;
b. a pair of footers secured within and running the length of said channel of said U-shaped base;
c. a first base support lip and a second base support lip are part of said U-shaped base;
d. said first base support lip is parallel to and oppositely disposed from said second base support lip;
e. said footers include a pair of unitary footers within said U-shaped base comprised of a first unitary footer and a second unitary footer;
f. said first unitary footer is adjacent and parallel to said first base lip;
g. said second unitary footer is adjacent and parallel to said second base lip;
h. said first unitary footer and said second unitary footer are symmetrical and generally L-shaped;
i. said first unitary, L-shaped footer has a first leg of said L-shape parallel and adjacent to said first base lip;
j. said second unitary, L-shaped footer has a second leg of said L-shape parallel and adjacent to said second base lip;
k. a first flange secured to said first leg and substantially perpendicular to said first base lip; and
l. a second flange secured to said second leg and substantially perpendicular to said second base lip.

20. In a ring binder, said ring binder including a binder spine, a paperlock secured to said binder spine, a first binder cover movably secured to said binder spine at one side of said paperlock, a second binder cover oppositely disposed from first binder cover and movably secured to said binder spine at an opposing side of said paperlock, said second binder cover combining with said first binder cover combine to form a binder opening, said binder opening being oppositely disposed from said binder spine and encasing paperlock within said ring binder, the improvement comprising: a footed device having sufficient length to protect material contained within said ring binder and sufficient width to render said ring binder substantially flat in closed configurations to thereby simplify storing of said ring binder wherein:

a. said footed device includes a U-shaped base, said U-shaped base having a channel;

b. a pair of footers secured within and running the length of said channel of said U-shaped base;

c. a first base support lip and a second base support lip are part of said U-shaped base;

d. said first base support lip is parallel to and oppositely disposed from said second base support lip;

e. said footers include a pair of slotted footers within and running the length of said channel of said U-shaped base;

f. said slotted footers have an enlarged, knobbed end with a knobbed slot;

g. a flexible bar is secured in each of said knobbed slots to contact said binder; and h. said slotted footers are secured to said knobbed support at a knob base, said knob base being oppositely disposed from said knobbed end.

* * * * *